US005385266A

United States Patent [19]

Pate

[11] Patent Number: 5,385,266

[45] Date of Patent: Jan. 31, 1995

[54] ANTI-THEFT DEVICE FOR COIN OPERATED NEWSPAPER DISPENSER

[76] Inventor: Ronald Pate, 3700 Carlisle Close Apt. #883, Mobile, Ala. 36609

[21] Appl. No.: 159,383

[22] Filed: Nov. 30, 1993

[51] Int. Cl.[6] ..... G07F 11/00

[52] U.S. Cl. ..... 221/76; 221/287; 211/164

[58] Field of Search ..... 221/76, 90, 81, 82, 221/83, 197, 287, 119, 121, 154, 249, 248, 277

[56] References Cited

U.S. PATENT DOCUMENTS 1,645,442 10/1927 Meyer ..... 221/82
1,885,324 11/1932 Bjornson ..... 221/83
2,369,970 2/1945 McClearen ..... 242/55.2
4,483,491 11/1984 Rainey ..... 242/55.2
4,498,603 2/1985 Wittenberg ..... 221/76
4,621,746 11/1986 Reichle et al. ..... 221/76

*Primary Examiner*—Kenneth W. Noland

[57] ABSTRACT

A newspaper vending machine is described holding individual newspapers in a carrousel which rotates within a closed tube. The carrousel is separated into a plurality of discrete chambers by platforms. The carrousel rotates relative to the tube. The tube defines an opening through which a single platform may be accessed as the carrousel rotates within the tube. A mechanism operates in conjunction with the door to the vending machine to rotate the carrousel as the door is opened.

25 Claims, 7 Drawing Sheets

ANTI-THEFT DEVICE FOR COIN OPERATED NEWSPAPER DISPENSER

BACKGROUND OF THE INVENTION

This invention relates broadly to the art of newspaper vending machines. More particularly, this invention relates to newspaper vending machines for vending single copies or single copy vending machines for newspapers and the like.

PRIOR ART

The need for a safe and inexpensive method of dispensing newspapers while discouraging the theft of newspapers is well known in the prior art. Every year millions of dollars are lost by paper sellers as a result of persons paying a single fee and retrieving an entire rack of newspapers.

The problem is sufficient so that burglar alarms have been designed just for vending racks (Sauls, U.S. Pat. No. 4,876,532).

Examples of anti-theft devices for use in coin operated machines include Redal, U.S. Pat. No. 4,981,236 which uses a pivoted gate to block the stack of newspapers below the one to be dispensed and also includes a locking mechanism to prevent more than one paper coming out at a time; Rule, U.S. Pat. No. 818,296 which uses a series of slotted doors; Pinkerton, U.S. Pat. No. 3,912,124 which uses a slot through which papers drop into a dispensing slot; Lewindowski, U.S. Pat. No. 4,865,178, which uses a spring-loaded paper tray with pulleys which is incrementally advanced with a sensing mechanism to determine where the top of one paper is or the next which literally pulls newspapers one at a time out of the racks for dispensing; Brown, U.S. Pat. No. 4,331,261 which is important because it was designed to be retrofitted into an existing newspaper rack and has a tongue which only allows for one newspaper to be removed at a time from a stack; Owens, U.S. Pat. No. 4,238,127 which utilizes a swinging arm to dispense one newspaper into a slot at a time which is similar in function to Goodley, U.S. Pat. No. 4,389,000, Gordon U.S. Pat. No. 397,175, and Daniels, U.S. Pat. No. 4,802,602 all of which use various slides or arms to pull one paper at a time off of a slide.

An additional patent which is of some interest because it incorporates a barrel is the Zebarth, U.S. Pat. No. 1,240,526 which utilizes a drum on which a newspaper displayed. Papers are dispensed through a slotted mechanism while another newspaper is mounted on the rotating drum for viewing.

Cats, U.S. Pat. No. 5,042,371 shows the use of an apparatus for storing and bundling recyclable material for purposes of wrapping to be put around the recyclable material.

All of these patents share common problems with loading the device, the number of papers it can hold, and complex mechanisms which can either fail to function, thereby preventing the dispensing of a newspaper or which can jam preventing a newspaper from issuing from the device.

GENERAL DISCUSSION OF THE INVENTION

The present invention addresses problems in the prior art by providing for a newspaper dispensing mechanism which may be retrofitted into an existing newspaper rack, limits the number of mechanisms required in order to issue paper, is easy to load, is safe and reliable for the consumer.

In order to accomplish this, the invention incorporates a series of platforms mounted onto a barrel. Each of the platforms is wide enough to contain a newspaper. In the preferred embodiment, this barrel is made to turn to expose a single newspaper in response to opening the door. The door may be a standard newspaper door which is tied into a coin operated lock as is common in the art.

A tube surrounds this barrel to hold the papers within the barrel. A slot in the tube allows access to one paper tray. In the preferred embodiment, the barrel spins freely in the tube and the barrel is referred to as a carrousel. In alternate embodiments, this outer tube could be replaced with individual doors closing the barrel slots, although this would substantially depart from the basic concept embodied herein.

In cases where free papers are distributed, the door need not be locked. The invention would still act to deter removal of large numbers of papers.

Another embodiment would allow the user to rotate this barrel prior to putting in a coin to open the device so as to align a newspaper with the slot in the tube. The device could also be set up so that if there is not a newspaper in a rack, the coin will be returned. These modifications might be desired in the event that newspapers were not loaded properly.

At the time that the device is open, the barrel mechanism is stopped from rotating to prevent multiple papers from being issued.

In the preferred embodiment, the invention functions by having the opening of the paper door turn the carrousel. The mechanism prevents the rotation of the barrel except in response to the opening of the door. A window is provided to allow the user to verify the availability of a newspaper. A written indication on this window may warn the user not to deposit money unless a paper is visible in the window.

Once open, only a single rack on the barrel can be accessed through a shield between the barrel and the user. In the preferred embodiment, this shield is a slot on a tube containing the barrel.

The slot or opening through which the newspapers are retrieved has a widened center portion. A user's hand can easily fit within this opening in the middle. On the edges of the opening, the slot narrows to prevent more than one newspaper being retrieved at a time.

The preferred embodiment has a set of rails which extend on either side to the front of the newspaper vending box. The barrel has a central spindle which fits onto these rails. In this way the carrousel may roll into place at the back of these rails within the newspaper vending box.

An alternative embodiment would utilize a telescoping receiving arm mounted onto the rails. When the arm is pulled it is telescoped outward. A notch may be present which can receive a barrel loaded with newspapers. Once the barrel is inserted, the telescoping arms could be slid back into place.

At the rear of the rails, where the carrousel will sit, there is a pawl gear which will cooperate with a spindle gear on the central axis of the barrel.

When the doors open, the pawl gear is locked onto the spindle gear to rotate the barrel and to prevent more than one newspaper from being retrieved for each time the door is opened.

Also disclosed herein is the mechanism for loading papers into a barrel for purposes of loading the machines.

These and other objects and advantages of the invention will become better understood hereinafter from a consideration of the specification with reference to the accompanying drawings forming part thereof, and in which like numerals correspond to parts throughout the several views of the invention.

BRIEF DESCRIPTION OF THE DRAWINGS

For a further understanding of the nature and objects of the present invention, reference should be made to the following detailed description taken in conjunction with the accompanying drawings in which like parts are given like reference numerals.

DETAILED DISCUSSION OF THE PREFERRED EMBODIMENT(S)

Figure 1:
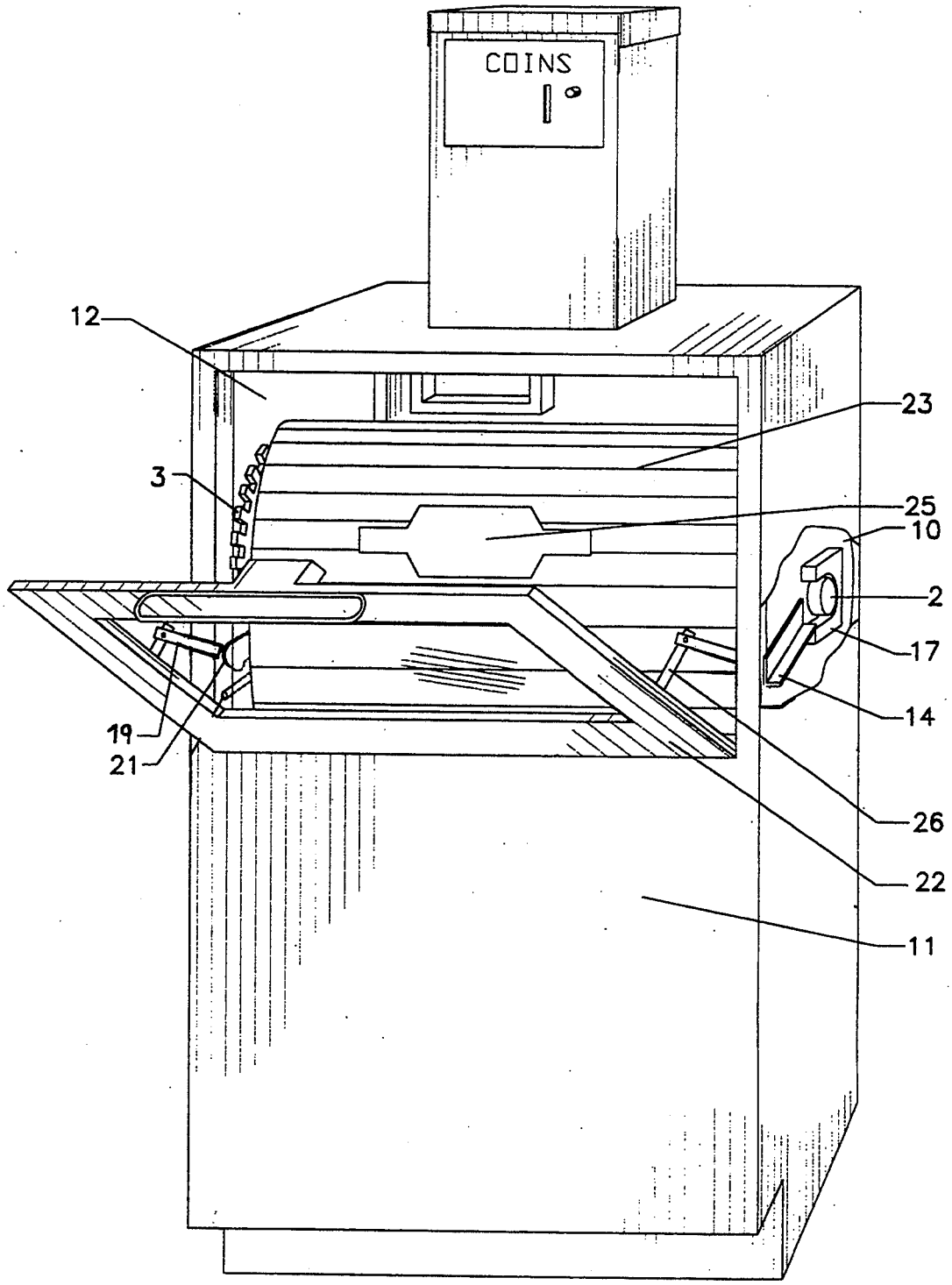
FIG. 1 is a plan view of the preferred embodiment without the cover plate described in FIGS. 6A and 6B.
Figure 4:
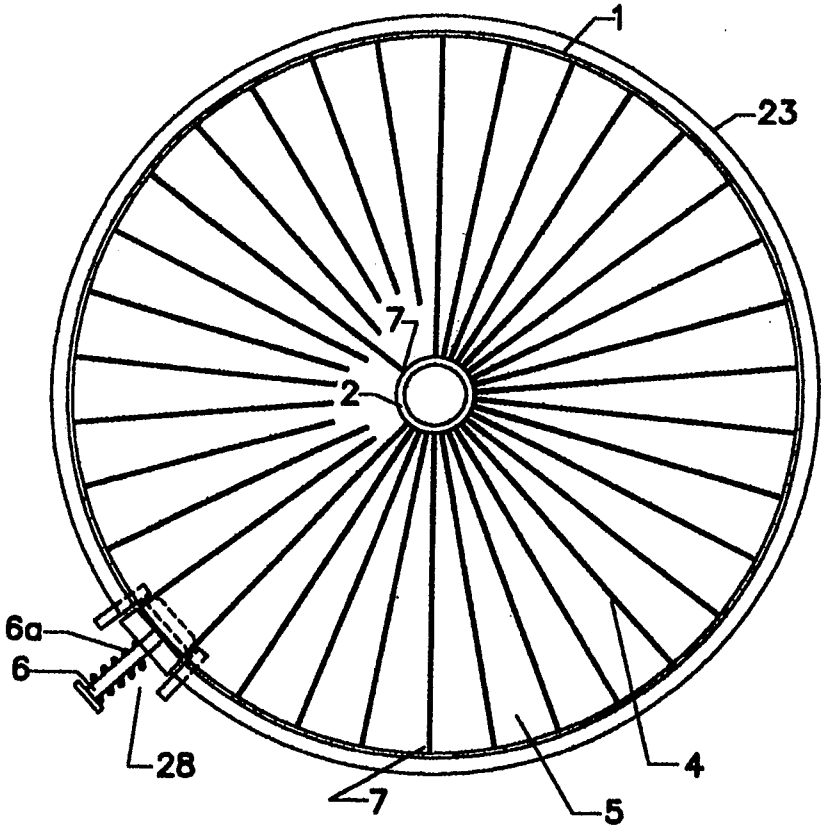
FIG. 4 shows a side cross sectional view of the carrousel shown in FIG. 1.

Referring to FIG. 1, the invention comprises a barrel 1 or carrousel (not shown) rotating within a tube 23 within a newspaper rack. The barrel 1, shown on FIG. 4, is divided into discrete chambers 5 by separators 4 which are broad flat platforms 4 which serve to receive newspapers (not shown). A central spindle or axis 2 has a joining means 7 which may be longitudinal cut or glue to receive one end of each of the separators 4. A series of radiating grooves or glue (not shown) may also be provided along the outer walls 10 of the barrel 1 serve to hold the separators 4 in place and properly spaced. Grooves and longitudinal cuts could be replaced or augmented with glue where the distance between separators 4 was to be fixed.

Each of the platforms or separators 4 is wide enough to contain a newspaper which may be folded. The distance between two separators 4 is sufficient to receive a newspaper of the desired size and with the desired number of folds. By removing a separator 4, the chamber 5 may doubled in size for larger newspapers.

The barrel 1 is of a predetermined size so that it can fit within a housing 12 defined by a newspaper box 11. In order to simplify loading the carrousel into the housing 12, the housing may be equipped with rails 14 to receive the barrel 1.

Alternatively, the housing 12 may be equipped on either side with a telescoping arm. This telescoping arm may be mounted within an arm brackets made up of rails 14 on bearings to allow it to easily slide in with a loaded barrel 1 or to slide out with an empty barrel 1.

Figure 2:
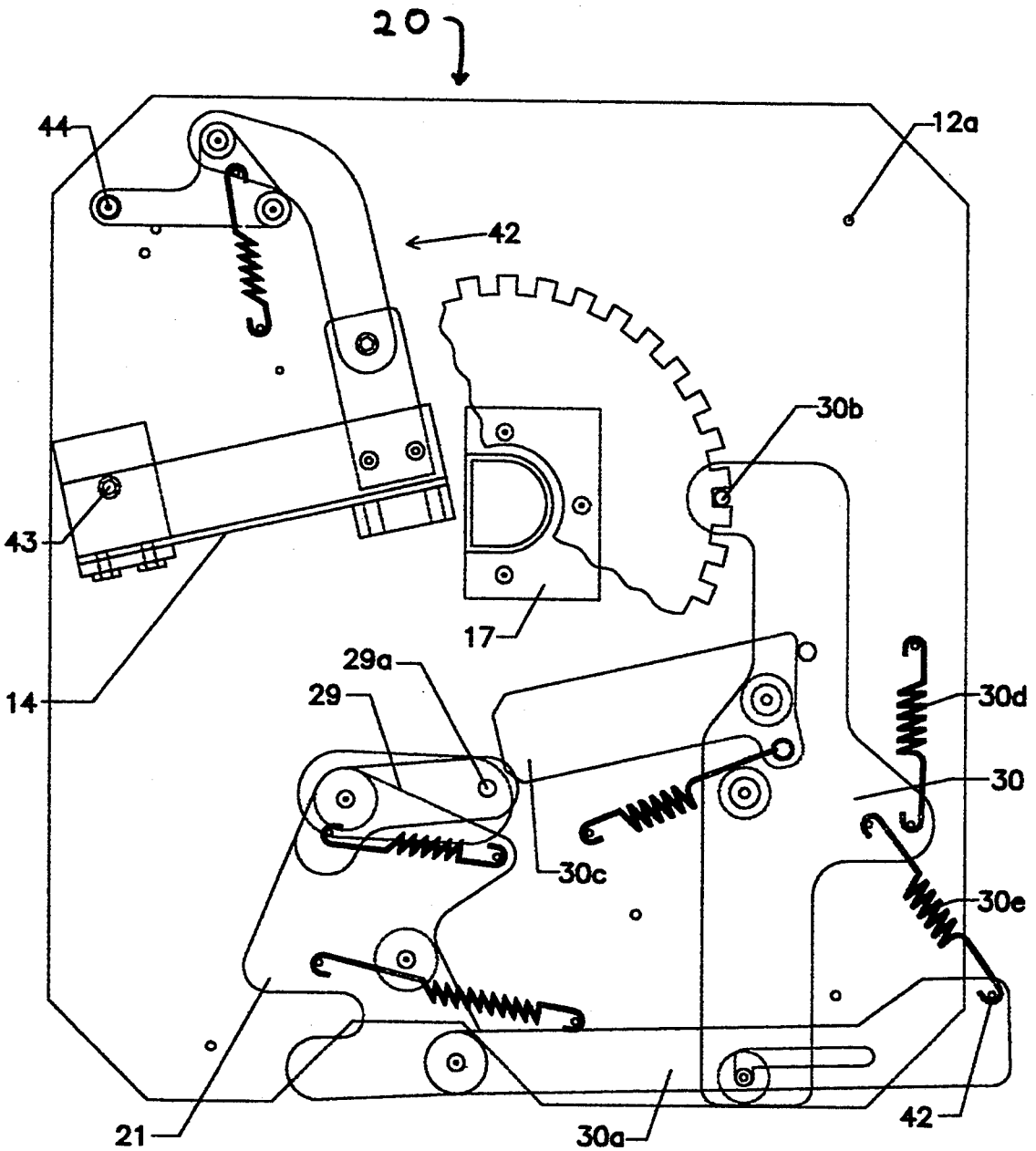
FIG. 2 is a detailed view of the mechanism for rotating the barrel shown in FIG. 1.
Figures 2A, 2B, 2C:
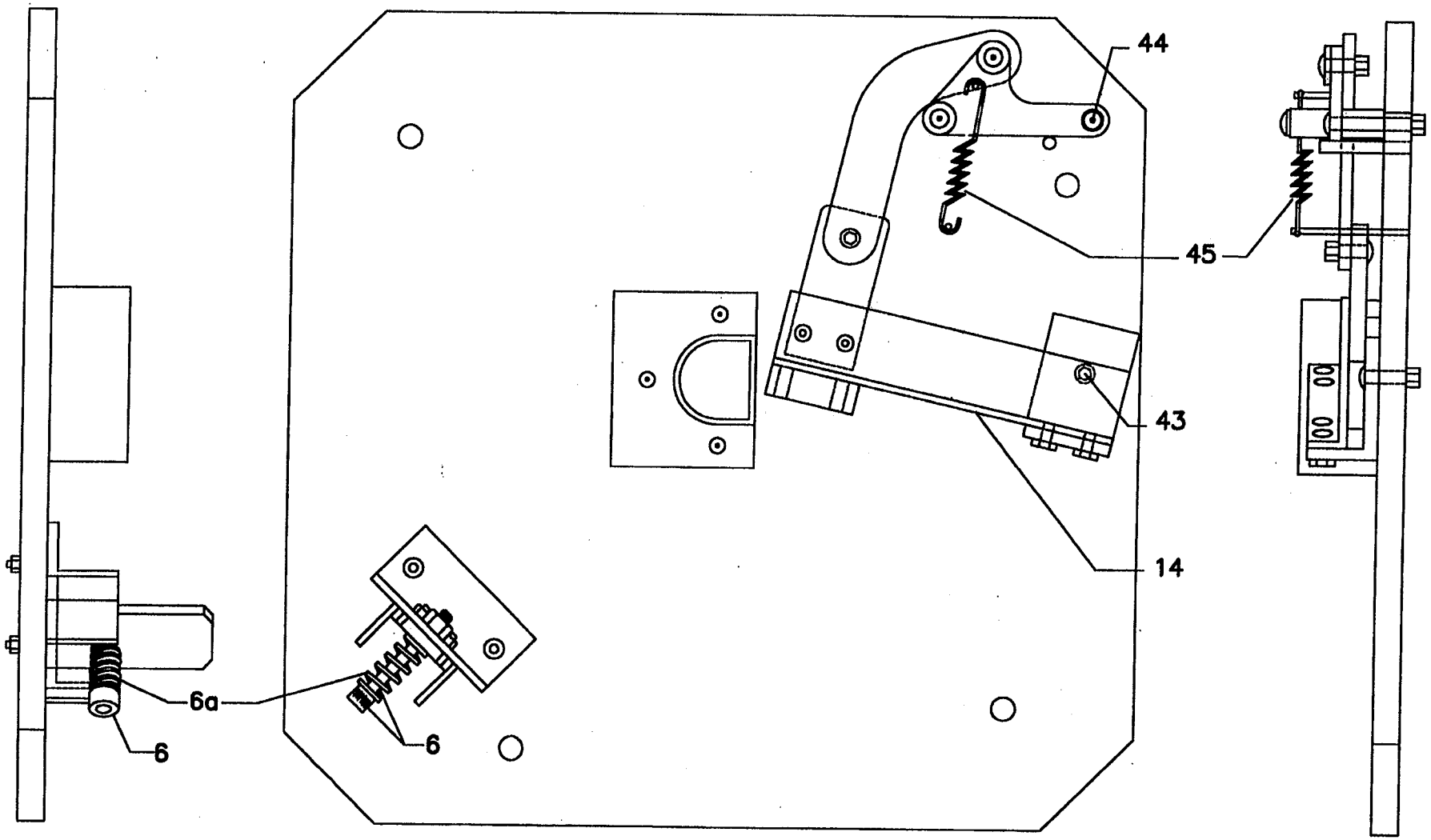
FIG. 2A shows a portion of the mechanism for rotating as well as the locking mechanism 13 for stopping rotation of the barrel.
FIG. 2B is a side view of the locking mechanism 13 of FIG. 2A.
FIG. 2C is a side view of the 14 shown in FIG. 2A.

The rails 14 in the first alternative and the arms in the alternate embodiment define a notch 17 to receive the spindle 2 and hold it in the appropriate location in the housing 12. As shown in FIG. 2, a locking mechanism 42 serves to hold the spindle 2 within the notch 17. This mechanism 42 is the rail 14 pivoting around pivots 43 and 44. It is loaded by spring 45. The pivots and notch 17 are mounted to an end plate 46 which is mounted to the box 11.

Figure 3A:
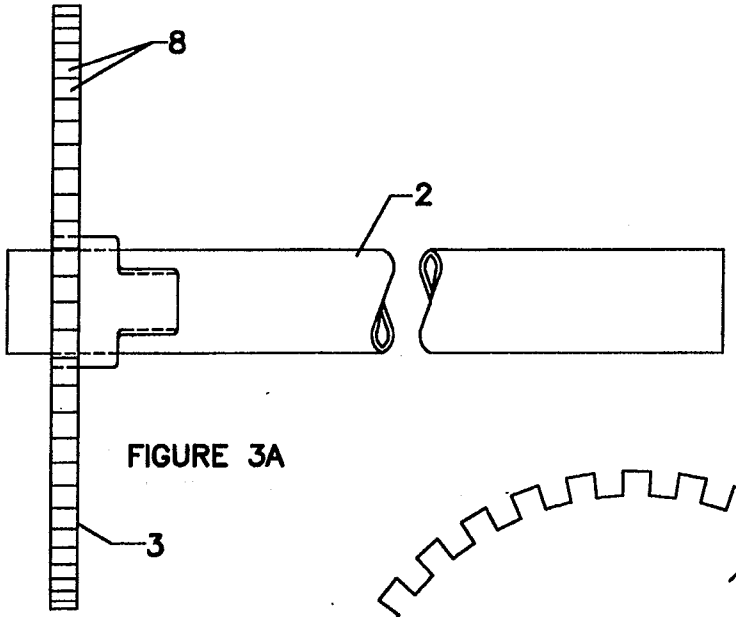
FIG. 3A shows the central spindle and spindle gear.
Figure 3C:
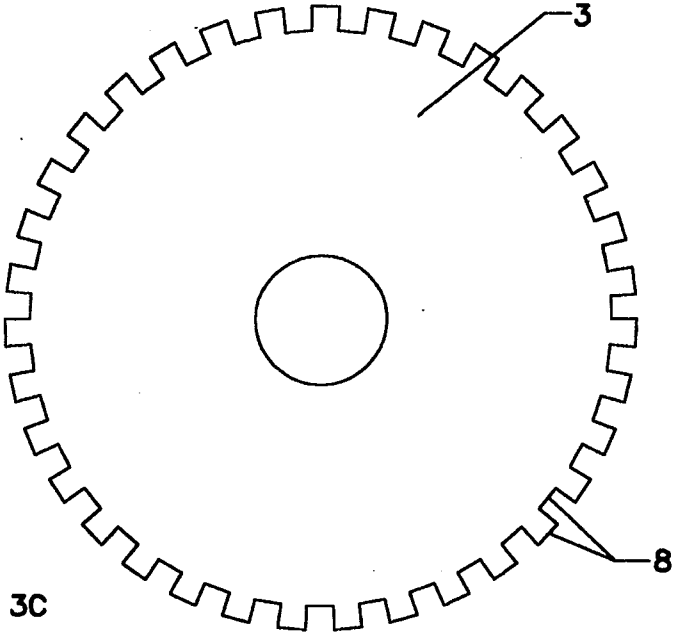
FIG. 3C shows a separate side view of the spindle gear of FIG. 3A.
Figure 3B:
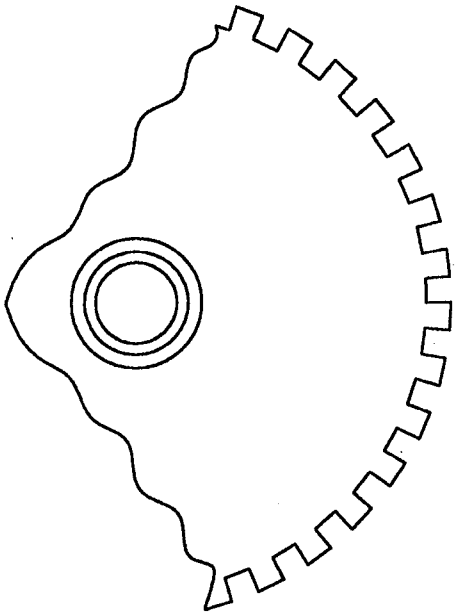
FIG. 3B shows a detailed view of the side of FIG. 3A.

As can be seen by reference to FIG. 1, the central spindle 2 extends beyond the outer walls 10 on either side of the barrel 1. As seen on FIG. 3A the spindle 2 supports a spindle gear 3 defining gear teeth 8. The spindle 2 is spun within the notch 17 by the turning of gear 3.

As seen in FIG. 4, the outer tube 23 is kept from rotating with the barrel 1. The outer tube 23 has a hole 28 which receives a locking pin 6 which is mounted to housing 12 at mounting 12(*a*). Pin 6 is spring loaded so that if it is not properly aligned it is compressed by the tube 23. As the tube 23 is spun with the barrel 1, the pin 6 and hole 28 are aligned, and the pin 6 is driven by the spring 6(*a*) into the hole 28 preventing further rotation of the tube 23.

Figure 6:
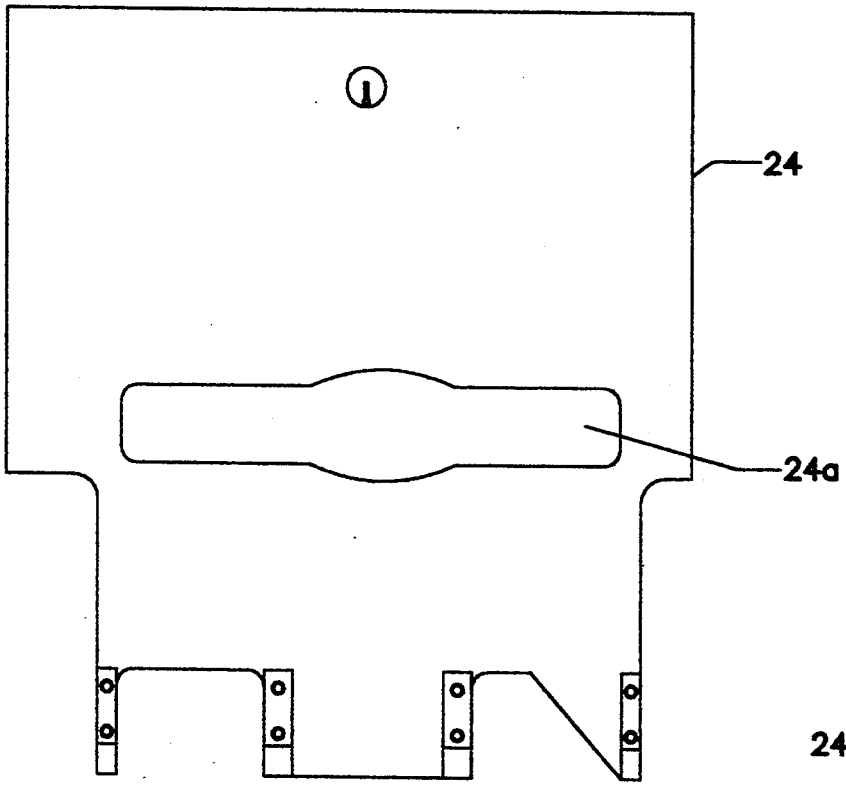
FIG. 6A shows a front view of a plate which fits between the carrousel and door of a newspaper vending machine.
FIG. 6B shows a side sectional view of the plate of FIG. 6A showing the locking brackets of the plate.
Figure 6A:
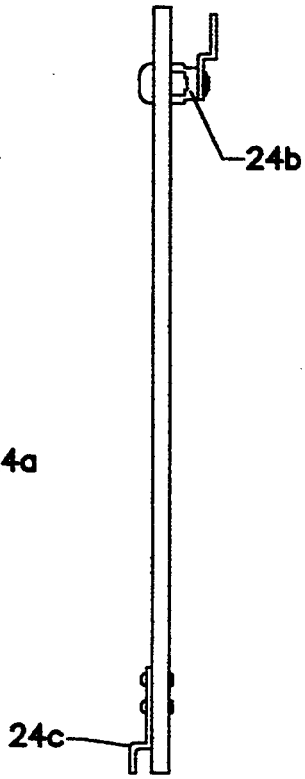

The newspaper box 11 has a door 22. This door 22 may be made to bulge outward to receive a portion of the barrel 1. Outer tube 23 defines an opening 25 which is widened in the middle to allow a hand to reach in and a paper to be easily withdrawn. The door 22 is mounted on the box 11 on either side with hinges 26. A coverplate 24 may be inserted between the door 22 and tube 23 to protect the interior mechanisms from being tampered with. This plate 24 would lock in place with lock 24(*b*) as shown in FIG. 6 (*a*). A bracket 24 (*c*) holds the plate 24 in place opposite lock 24(*b*). A slot 24(*a*) corresponds approximately in size and location to slot 24 in the outer tube 23.

Once open, only a single chamber 5 defined by the barrel 1 and platforms 4 can be accessed through slot 25.

Figure 5:
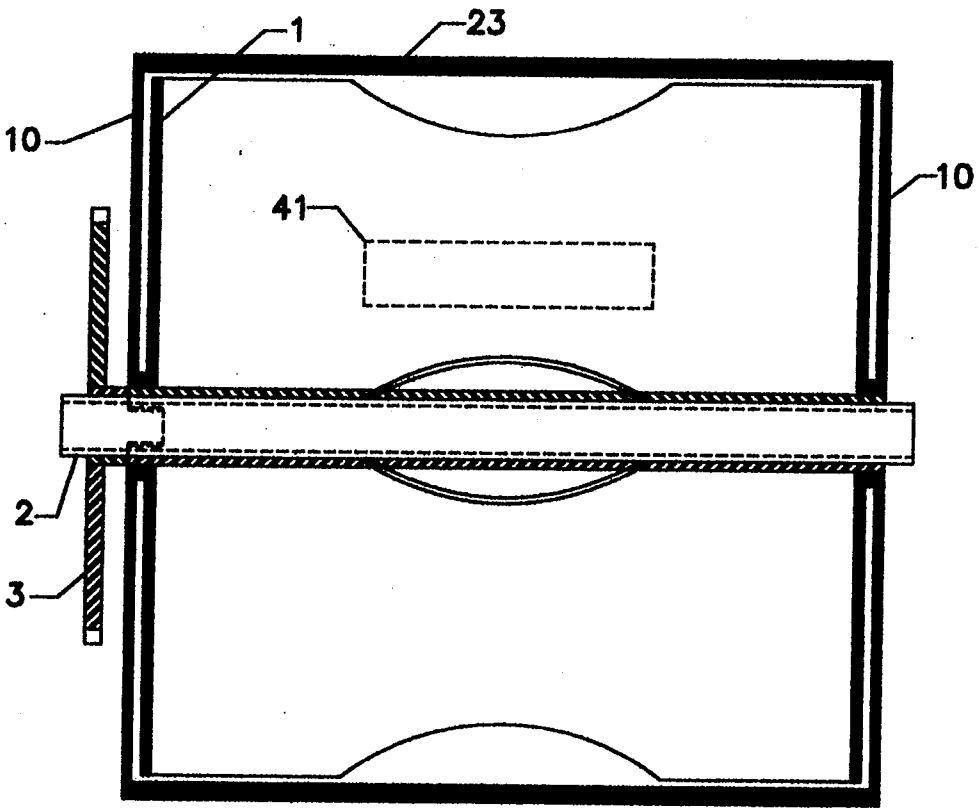
FIG. 5 shows a front view of the carrousel of FIG. 4.

The plate 24 may be clear. The tube 25 should also be clear or define a window 41 as shown in FIG. 5 so that the user can see if a paper is available. A suitable message may be provided under or on the window to instruct the user.

In the preferred embodiment this shield 24 fits in front of the outer tube 23 which fits over the barrel 21. A slot 24(*a*) in shield 24 is aligned with the slot 25 in tube 23 for the user to reach through for a newspaper a locking mechanism 24(*b*) holds the shield 24 in place. The shield 24 prevents tampering with the mechanisms holding the spindle 2 and spindle gear 3.

The outer tube 23 is mounted over spindle 2 contacts spindle 2 by bearings (not shown) so that it need not rotate with barrel 1 when the barrel 1 and tube 23 are inserted within the newspaper box 11.

The purpose of this outer tube 23 is to keep the papers in the barrel 21 while allowing them to be removed from the slot 24 when the door 22 is open and allowing the barrel 1 to rotate without losing papers.

In the preferred embodiment the door 22 is held shut by a coin activated lock mounted on the newspaper housing 12 and having a cooperating lock on the door 22 as is known and used in the art. This door 22 may be opened upon depositing at least one coin within the coin activated lock.

An actuator means 20 shown in FIG. 2 is provided for rotation of the barrel 1 upon opening the door 22. The actuator means 20 further acts as a stop means for restricting the movement of the barrel 1 so that the barrel may only be rotated by the opening of the door 22.

The actuator means 20 may be modified to allow for the rotation of the barrel 1 when the door 22 is closed.

The mechanism 20 controls the barrel 1 which allows the barrel to turn when money is deposited to a platform holding a paper and then the barrel 1 is locked into place until more money is deposited.

In an alternate embodiment, the user can rotate this barrel 1 prior to putting in a coin to open the device and at the time that the device is open, the barrel 1 is stopped from further rotation. Similarly, the device can be set up so that if there is not a newspaper in a rack, the coin will be returned until it is aligned with a newspaper.

The rotation mechanism 20 comprises spindle gear 3 defining teeth 8 mounted on the axis 2 of the barrel 1. The door has a portion mounted pivotally to the housing 12 which acts as a gear lever 19. Therefore, gear lever 19 is operated by opening door 22.

This lever 19 in turn drives a universal gear 21. Universal gear 21 pivots about a point as it is driven by lever 19. One side of universal gear 21 contacts and drives drive lever 29 as it pivots the drive lever 29. Another side of universal gear 21 contacts and drives a ratchet locking arm 30. Ratchet locking arm 30 engages the teeth 8 of the spindle gear 3 at pin 30(*b*) on the arm 30 away from the universal gear so as lock the movement of the barrel 1 when the door is opened to a certain extent or when the door 22 is closed.

In the preferred embodiment the ratchet locking arm 30 has a control arm 30(*a*) pivotably mounted onto the universal gear 21. This control arm 30(*a*) moves along a path and has a raised notch 42 which is pushed out as the arm 30(*a*) moves along its path when the door is closed pulling the pin 30(*b*) out of the locked position. When the arm 30(*a*) is pushed out, it pulls back locking arm 30 which is pivotably mounted over the raised notch 42. Locking arm 30 has a pin 30(*b*) at the end farthest from the mounting to arm 30(*a*) which fits between teeth 8 of the spindle gear 3.

The drive lever 29 pushes up against the spindle gear 3 as it is moved by the universal gear 21. During its push, pin 29(*a*) drops between the teeth 8 and rotates the barrel 1. A locking arm release arm 30(*c*) is driven by the drive lever 29 to push the locking arm 30(*b*) out of the teeth 8 as the drive lever 29 drives the barrel 1 by turning the spindle gear 3.

Pin 30(*b*) is pushed out by lever 29 so the barrel 1 may rotate. The locking arm 30 is pulled back to drop back onto the spindle gear 3 when the door is fully opened and may remain in place when the door is closed. This serves to lock the movement of the spindle gear 3 while the door 22 remains open.

When the door 22 is released, the universal gear 21 pulls the drive lever 29 out of contact with teeth 8 until the lever 29 is back at its original location.

When the door 2 is fully open, pin 29(*a*) rests above gear teeth 8 so the pine 29(*a*) can travel back to the next tooth to be pushed. As the door is closed pin 29(*a*) moves back and engages the next tooth to rotate the barrel when the door is opened again.

Figure 7A:
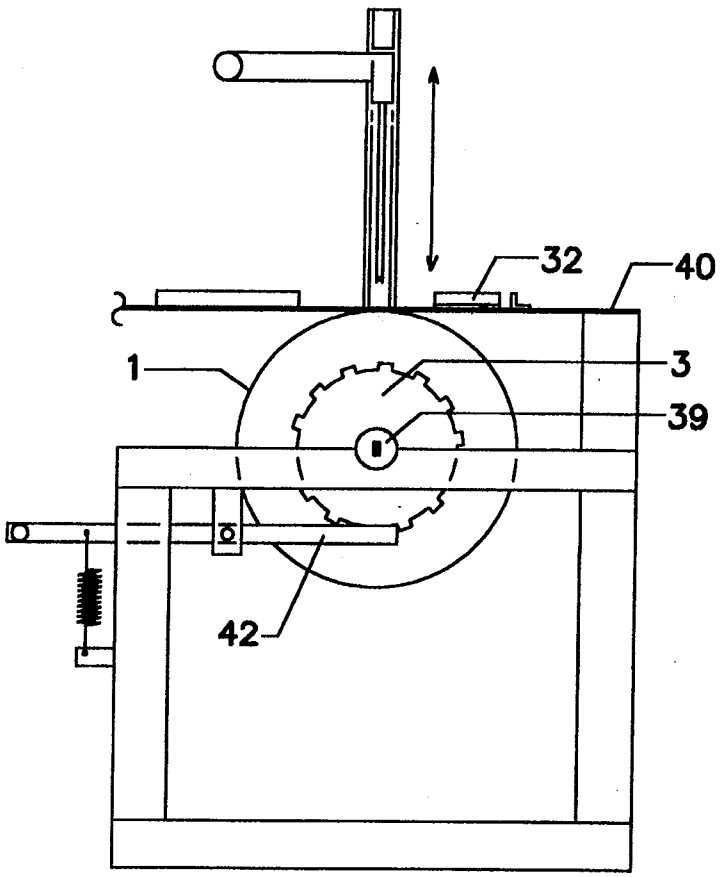
FIG. 7A shows a side view of the loader of FIG. 7.
Figure 7:
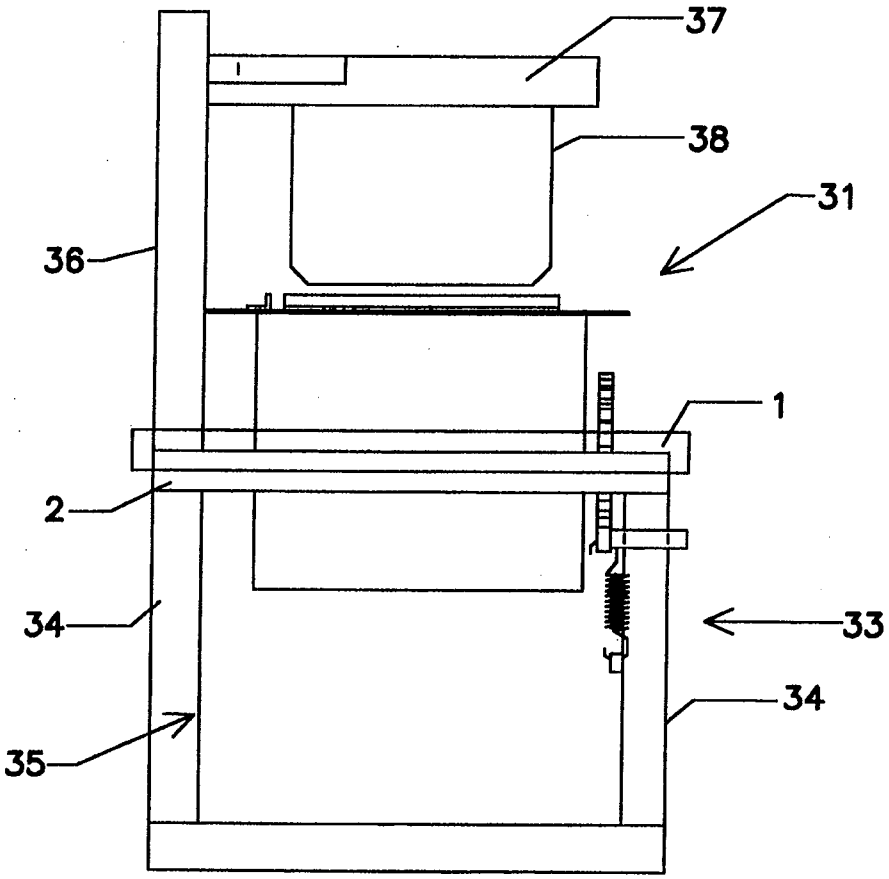
FIG. 7 shows a front view of a loader for a carrousel arrangement.

Also disclosed herein in FIGS. 7 and 7A is a mechanism 31 for loading papers 32 into the barrel 1. This mechanism 32 comprises a rack 33 having four legs 34. One of these legs contains a spring 35 which serves to spring load a loading arm 36. Loading arm 36 has an insertion arm 37 which arm serves as a mounting for guide 38.

A rack bracket 39 serves to hold the barrel 1. The three legs 34 which do not hold the loading arm 36 extend above the rack 38 and serve as a mounting for a newspaper feeder 40. This feeder 40 is a platform for receiving papers defining a slot 41.

When used, a barrel 1 has the platforms 4 inserted appropriately spaced to receive the newspapers of the desired size. A tube 23 is put over the barrel. The barrel 1 is then placed on the rack bracket 39. The outer tube opening 25 is facing up. Next the feeder 40 is put in place above the rack with the feeder slot 41 (not shown) aligned with the opening 25 (not shown).

The spindle gear 3 is engaged by a rack gear 42 which stops rotation of the barrel 1. The outer tube 23 will not rotate with the barrel 1. As the barrel 1 is rotated incrementally, a newspaper is put over the feeder slot 41, the loading arm is pushed down into leg 34 compressing spring 35 and driving the guide 38 onto the paper and pushing through the feeder slot 41. The paper is in this way inserted into the barrel 1. The spring pushes up the loading arm (which in turn raises the guide). The barrel is rotated incrementally to the next open platform and the process is repeated until the barrel is full.

The loaded barrel 1 can then be moved to a waiting truck and transported to a box 11 for loading.

Because many varying and different embodiments may be made within the scope of the inventive concept herein taught and because many modifications may be made in the embodiment(s) herein detailed in accordance with the descriptive requirements of the law, it is to be understood that the details herein are to be interpreted as illustrative and not in a limiting sense.

I claim:

1. A newspaper vending machine for distributing papers comprising:

(a) a display means having a central axis for holding a plurality of papers and for allowing retrieval of at least one of the plurality of papers at a time, said display means being rotatable about its axis wherein the display means further comprises;

(i) a barrel means for holding a plurality of papers defining an internal space and having an axis located centrally to the internal space;

(ii) a plurality of platforms intersecting approximately at the axis separating the internal space of the barrel means into paper trays and wherein the axis of the barrel means further comprises a central spindle (iii) a tube means for selectively holding papers and releasing papers within the central space;

(b) an actuator means for controlling the rotation of the display means so that a paper is displayed in response to an action by the user;

(c) a holding means for holding the display means rotatable about the axis and in contact with the actuator means;

and (d) further comprising a coin operated lock means for controlling access to the holding means and wherein the action of the user comprises the feeding, of at least one coin into the coin operated lock and wherein the tube means further comprises a tulle spindle having a tube axis and wherein the tube axis is disposed about the same centerline as the barrel axis so as to turn independently of the barrel axis.

2. The vending machine of claim 1 wherein the barrel means further comprises on side walls mounted to the central spindle and sufficiently close to the plurality of platforms so as to, maintain the position of papers within the platforms.

3. The vending machine of claim 1 wherein the holding means further comprises a door which may be opened and wherein the actuator means further comprises a gear means attached to the central spindle for rotating the spindle in response to movement associated with the opening of the door.

4. The vending machine of claim 1 wherein the tube means further comprises a tube mounted by a bearing means over the central spindle so that the barrel may rotate independently from the tube.

5. The invention of claim 1 wherein the tube means further comprises a locking means for restricting the movement of the tube to selectively allow assess to at least one of the plurality of papers.

6. The invention of claim 1 wherein the tube further comprises at least one opening through which papers can be retrieved.

7. The invention of claim 6 wherein the tube further defines at least one window for viewing at least one paper if available.

8. The invention of claim 1 wherein the holding means further defines a housing and at least one rail attached to the housing for receiving, guiding and rotatable holding the display means by its axis.

9. The invention of claim 8 wherein the display means axis further comprises a spindle having a left end and a right end extending substantially beyond the plurality of platforms on at least one of the two ends to serve to attach the barrel to the rail.

10. The invention of claim 9 wherein the holding means comprises two rails, one being on the left and one being on the right for receiving the spindle two ends on either side.

11. The invention of claim 10 wherein the holding means further comprises two extendable arms movable within the rails so that the arms may be extended to receive the spindle.

12. The invention of claim 8 wherein the holding means comprises a notch mounted to the holding means at the end of the rail for receiving the display means axis from the rail.

13. The invention of claim 1 wherein the housing means further comprises an interior compartment and a door means for allowing access to the interior compartment and wherein the holding means holds the tube so that the opening faces the door means so that the papers may be retrieved from the opening when the door means is opened.

14. The invention of claim 13 wherein the door means further comprises a coin activated lock mounted on the housing means and a door which may be opened upon depositing at least one coin within the coin activated lock.

15. The invention of claim 14 wherein the actuator means comprises a rotation means for rotation of the display means upon opening the door.

16. The invention of claim 15 wherein the rotation means further comprises a spindle gear defining teeth mounted on the axis of the display means and a gear lever means mounted on the housing and operated by attachment to the door so as to engage and rotate the spindle gear thereby rotating the display means when the door is opened.

17. The invention of claim 16 wherein the gear lever means further comprise a ratchet locking arm which serves to engage the teeth of the spindle gear so as restrict movement of the display means when the door is opened to a predetermined spot to prevent the user from turning the display means further.

18. The invention of claim 17 wherein the ratchet means further comprises a ratchet activating arm which serves to disengage the ratchet locking arm when the door is being opened and to engage the teeth of the spindle gear and advance the rotation of the spindle gear so as to turn the display means so as to display the next paper in the display means.

19. The invention of claim 18 wherein the ratchet activating arm serves to disengage the ratchet locking arm when the door is closed.

20. The invention of claim 19 wherein the door defines a lever which contacts the ratchet gear to rotate the ratchet gear and also contacts the locking arm to disengage the locking arm and pushing the spindle gear and having a point in its travel where it is moved to release the locking arm so that the locking arm is allowed to reengage the spindle gear and wherein the locking arm is biased so as to engage the spindle gear.

21. The invention of claim 14 wherein the actuator means further comprises a stop means for restricting the movement of the display means so that the display means may only be rotated as the door is opened by the actuator means.

22. The invention of claim 21 wherein the stop means further comprises a release means to disengage the stop means further comprises a release means to disengage the stop means to allow for the rotation of the display means when the door is closed as well as when the door is opened.

23. A newspaper vending machine for distributing papers comprising:

(a) a display means having a central axis for holding a plurality of papers and for allowing retrieval of at least one of the plurality of papers at a time, said display means being rotatable about its axis wherein the display means further comprises;

(i) a barrel means for holding a plurality of papers defining an internal space and having an axis located centrally to the internal space;

(ii) a plurality of platforms intersecting approximately at the axis separating the internal space of the barrel means into paper trays and wherein the axis of the barrel means further comprises a central spindle (iii) a tube means for selectively holding papers and releasing papers within the central space;

(b) an actuator means for controlling the rotation of the display means so that a paper is displayed in response to an action by the user;

(c) a holding means for holding the display means rotatable about the axis and in contact with the actuator means;

and (d) wherein the holding means further defines a movement restriction means which restricts the tube movement so that at least one of the plurality of papers is maintained in a position accessible by the user and wherein the movement restriction means further comprises an opening defined by the tube and a cooperating pin mounted on the holding means and insertable within the tube opening.

24. The invention of claim 23 wherein the tube opening and pin holding means cooperate so that the holding means guides the tube to be in contact with the pin.

25. The invention of claim 24 wherein the pin is spring loaded so that it may be compressed by the tube until the tube is rotated within the holding means to expose the pin to the opening whereupon the pin may enter the tube opening and wherein the tube is rotatable within the holding means.

* * * * *